US007468157B2

(12) United States Patent
Barrett

(10) Patent No.: US 7,468,157 B2
(45) Date of Patent: Dec. 23, 2008

(54) IMPACT PAD FOR METALLURGICAL VESSELS

(75) Inventor: Ronald Barrett, Fenelton, PA (US)

(73) Assignee: North American Refractories Co., Moon Township, PA (US)

( * ) Notice: Subject to any disclaimer, the term of this patent is extended or adjusted under 35 U.S.C. 154(b) by 419 days.

(21) Appl. No.: 11/302,886

(22) Filed: Dec. 14, 2005

(65) Prior Publication Data

US 2007/0132162 A1 Jun. 14, 2007

(51) Int. Cl.
*C21C 5/44* (2006.01)

(52) U.S. Cl. ..... 266/283; 266/275

(58) Field of Classification Search ..... 222/594; 266/275, 283, 45
See application file for complete search history.

(56) References Cited

U.S. PATENT DOCUMENTS

| | | | | |
|---|---|---|---|---|
| 2,914,413 | A | 11/1959 | Mercer | 106/84 |
| 3,503,598 | A | 3/1970 | Babel et al. | 266/39 |
| 3,646,722 | A | 3/1972 | Salmi, III | 52/745 |
| 3,655,356 | A | 4/1972 | Javaux | 65/182 R |
| 3,665,870 | A | 5/1972 | Lewicki | 110/1 A |
| 4,043,543 | A | 8/1977 | Courtenay et al. | 266/275 |
| 4,177,855 | A | 12/1979 | Duchateau et al. | 266/275 |
| 4,424,756 | A | 1/1984 | Merkle | 110/332 |
| 4,475,470 | A | 10/1984 | Merkle | 110/332 |
| 4,715,586 | A | 12/1987 | Schmidt et al. | 266/275 |
| 4,744,544 | A | 5/1988 | LaBate et al. | 266/44 |
| 4,776,570 | A | 10/1988 | Vo Thanh et al. | 266/44 |
| 4,989,843 | A | 2/1991 | Dittrich et al. | 266/283 |
| 4,993,692 | A | 2/1991 | Brown et al. | 266/229 |
| D322,615 | S | 12/1991 | Zacharias | D15/144 |
| 5,072,916 | A | 12/1991 | Soofi | 266/275 |
| 5,110,096 | A | 5/1992 | Zacharias | 266/227 |
| 5,131,635 | A | 7/1992 | Soofi | 266/275 |
| 5,133,535 | A | 7/1992 | Soofi | 266/275 |
| 5,160,480 | A | 11/1992 | Vassilicos | 266/275 |
| 5,169,591 | A | 12/1992 | Schmidt et al. | 266/275 |
| 5,188,796 | A | 2/1993 | Soofi | 266/275 |
| 5,238,986 | A | 8/1993 | Montgomery | 524/365 |
| 5,246,209 | A | 9/1993 | Heaslip et al. | 266/229 |
| 5,358,551 | A | 10/1994 | Saylor | 75/584 |
| 5,395,096 | A | 3/1995 | Moreira et al. | 266/280 |
| 5,518,153 | A | 5/1996 | Zacharias et al. | 222/594 |

(Continued)

FOREIGN PATENT DOCUMENTS

CA 2082459 8/1993

(Continued)

OTHER PUBLICATIONS

Derwent Document No. 1995-358956, Nov. 1994, 2 pages.

(Continued)

*Primary Examiner*—Scott Kastler
(74) *Attorney, Agent, or Firm*—Kusner & Jaffe

(57) ABSTRACT

An impact pad for a bottom lining of a metallurgical vessel, such as a ladle. The impact pad reduces wear to side walls of the metallurgical vessel by controlling the flow of an incoming stream of molten metal to minimize splashing and turbulence. The impact pad includes a frame portion and a bottom wall portion. The frame portion and bottom wall portion define an interior cavity for receiving the stream of molten metal.

68 Claims, 8 Drawing Sheets

U.S. PATENT DOCUMENTS

| | | | | |
|---|---|---|---|---|
| 5,551,672 | A | 9/1996 | Schmidt | 266/229 |
| 5,662,823 | A | 9/1997 | Claar et al. | 222/594 |
| RE35,685 | E | 12/1997 | Schmidt et al. | 266/275 |
| 5,704,184 | A | 1/1998 | Meloy | 52/608 |
| 5,761,859 | A | 6/1998 | Duda | 52/204 |
| 5,800,775 | A | 9/1998 | Vihnicka et al. | 266/230 |
| 5,861,121 | A | 1/1999 | Heaslip et al. | 266/45 |
| 5,879,616 | A | 3/1999 | Erny | 266/45 |
| 5,882,583 | A | 3/1999 | Erny | 266/283 |
| 6,017,487 | A | 1/2000 | Fish | 266/283 |
| 6,024,260 | A | 2/2000 | Zacharias et al. | 222/594 |
| 6,102,260 | A | 8/2000 | Heaslip et al. | 222/594 |
| 6,156,260 | A | 12/2000 | Heaslip et al. | 266/45 |
| 6,159,418 | A | 12/2000 | Zacharias | 266/275 |
| 6,554,167 | B1 | 4/2003 | Barrett | 222/594 |
| 6,673,306 | B2 | 1/2004 | Abrino et al. | 266/275 |
| 6,787,098 | B2 | 9/2004 | Abrino et al. | 266/44 |
| 2004/0070123 | A1 | 4/2004 | Morales et al. | 266/275 |

FOREIGN PATENT DOCUMENTS

| | | | |
|---|---|---|---|
| GB | 2 164 281 | | 3/1986 |
| GB | 2238495 | A * | 6/1991 |

OTHER PUBLICATIONS

Derwent Document No. 1995-358957, Nov. 1994, 2 pages.

Isenberg-O'Loughlin, "Taming the Thunder," Metal Producing, pp. 21-23 and 47, Sep. 1994.

* cited by examiner

IMPACT PAD FOR METALLURGICAL VESSELS

FIELD OF THE INVENTION

The present invention relates generally to an impact pad for a metallurgical vessel, and more particularly to an impact pad that reduces wear to the wall of a metallurgical vessel by controlling the flow of an incoming stream of molten metal to minimize splashing and turbulence. The present invention is particularly applicable for use in ladles used in handling molten steel, and will be described with particular reference thereto.

BACKGROUND OF THE INVENTION

Molten metal, in particular molten steel, is often poured from one metallurgical vessel to another. For example, molten metal may be poured from a furnace into a ladle, and then from a ladle into a tundish and from a tundish into a mold. Ladles typically have a generally horizontal or flat circular bottom with a vertically arranged side wall, sometimes referred to as a "barrel." The bottom and side wall have a lining made of refractory materials. It is known to use impact pads to try to control the incoming stream of molten metal to reduce erosion of the lining, and to effect certain desirable flow patterns inside the ladle. Accordingly, an impact pad may be located in the bottom lining to receive the impact of the stream of molten metal as it is being poured into the ladle.

The worst wear to ladles is often observed in the region where the bottom meets the side wall proximate to the impact pad. High wear occurs in this region due to splashing and turbulence of the molten metal as it hits the impact pad.

Prior efforts to reduce wear to the ladle include the following: providing a raised or thicker impact area in the bottom of the ladle; casting wall protectors proximate to the impact pad; using domed or pyramid shaped impact pads to divide liquid flow; using higher quality and/or thicker bricks for the side wall of the ladle proximate to the impact area; and combinations thereof.

Each of the foregoing approaches has drawbacks. In this regard, providing a raised or thicker impact area in the bottom of the ladle may increase the life of the impact pad, but it does not provide protection for the ladle side wall. Casting wall protectors requires significant labor and downtime to set a form, cast and set the castable material, and remove the form following setting of the castable material. Domed and pyramid shaped impact pads may redirect flow of the molten metal to other regions of the ladle, but do not minimize turbulence. Consequently, wear may simply occur in a different region of the ladle. Using higher quality and/or thicker bricks for the side wall requires additional expense that does not address the underlying cause of the wear problem.

The present invention overcomes these and other problems and provides an impact pad that controls the flow of the molten metal to reduce wear to a metallurgical vessel caused by splashing and turbulence of the molten metal.

SUMMARY OF THE INVENTION

In accordance with the present invention, there is provided an impact pad for receiving a stream of molten metal in a ladle. The impact pad comprises: (a) a bottom wall portion with an upper surface against which the molten metal is intended to impact, said bottom wall portion comprised of a plurality of refractory bricks; and (b) a frame portion surrounding the bottom wall portion and comprised of a cast refractory material. The frame portion includes first and second side walls extending in an upward direction along the periphery of the bottom wall portion, and a rear wall extending in an upward direction along the periphery of the bottom wall portion.

In accordance with another aspect of the present invention, there is provided a lining for a bottom of a ladle. The lining comprises: (1) an impact pad comprised of: (a) a bottom wall portion with an upper surface against which the molten metal is intended to impact, said bottom wall portion comprised of a plurality of refractory bricks; (b) a frame portion surrounding the bottom wall portion and comprised of a cast refractory material, said frame portion having: first and second side walls extending in an upward direction along the periphery of the bottom wall portion, and a rear wall extending in an upward direction along the periphery of the bottom wall portion; and (2) a monolithic slab of a high-temperature refractory material encasing said impact pad.

In accordance with yet another aspect of the present invention, there is provided a lining for a bottom of a ladle. The lining comprises: (1) an impact pad comprised of: (a) a bottom wall portion with an upper surface against which the molten metal is intended to impact; (b) a frame portion surrounding the bottom wall portion and comprised of a cast refractory material, said frame portion integrally cast with said bottom wall portion, said frame portion having: first and second side walls extending in an upward direction along the periphery of the bottom wall portion, and a rear wall extending in an upward direction along the periphery of the bottom wall portion; and (2) a monolithic slab of a high-temperature refractory material encasing said impact pad. The first and second side walls and said rear wall of the impact pad extend above an upper surface of said monolithic slab.

An advantage of the present invention is the provision of an impact pad for controlling the flow of molten metal poured into a metallurgical vessel to reduce wear to the vessel.

Another advantage of the present invention is the provision of an impact pad that minimizes splashing of molten metal poured into a metallurgical vessel.

A still further advantage of the present invention is the provision of an impact pad that minimizes turbulence in molten metal poured into a metallurgical vessel.

Still another advantage of the present invention is the provision of an impact pad that eliminates the need to use higher quality and/or thicker bricks in the lining of a metallurgical vessel in order to reduce wear thereto.

Yet another advantage of the present invention is the provision of an impact pad that reduces wear to a metallurgical vessel at less cost and with less time consumption than prior art approaches for reducing wear.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE INVENTION

Figure 1:
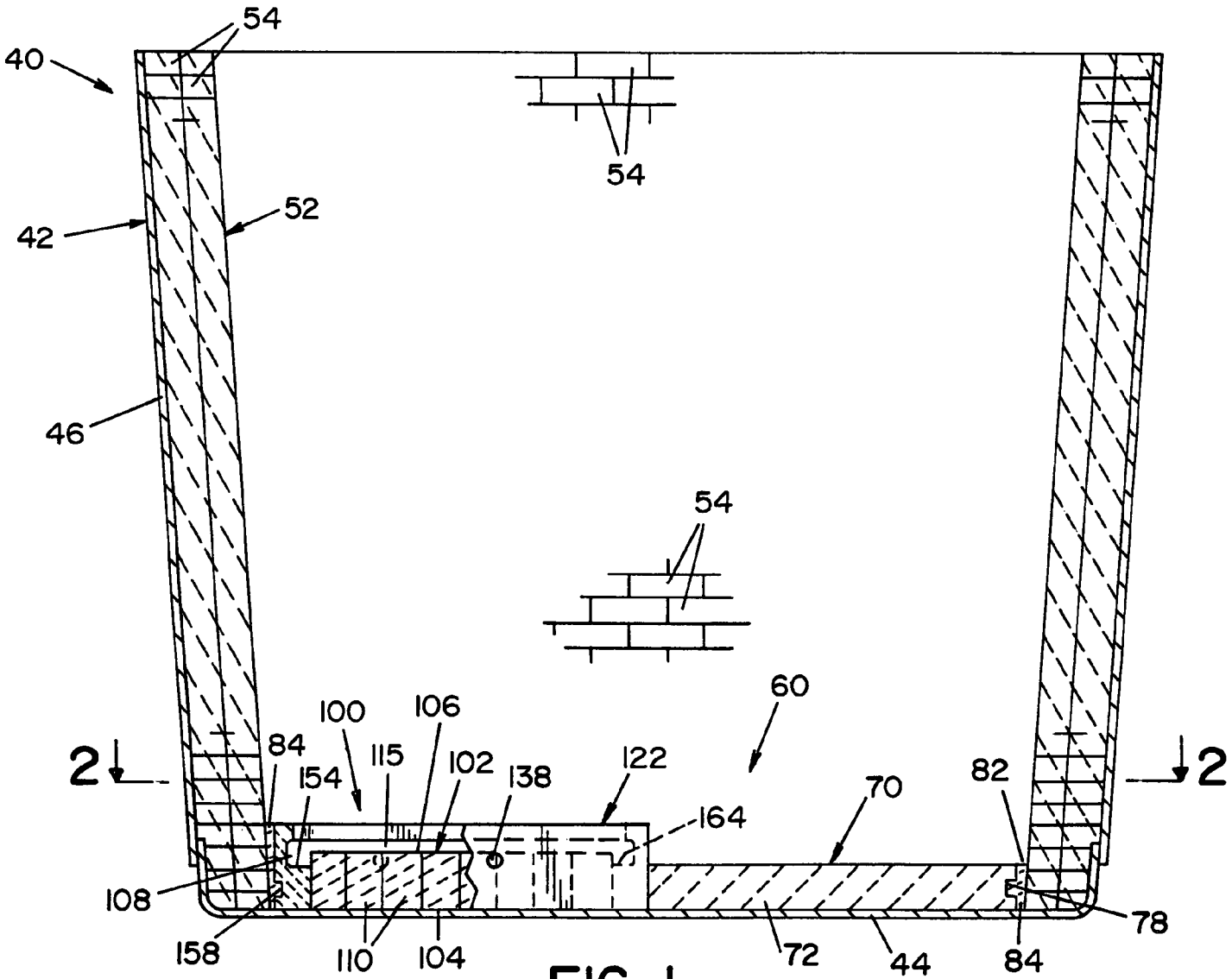
FIG. 1 is a side, sectional view of a ladle for handling molten steel, showing an impact pad according to a first embodiment of the present invention.
Figure 2:
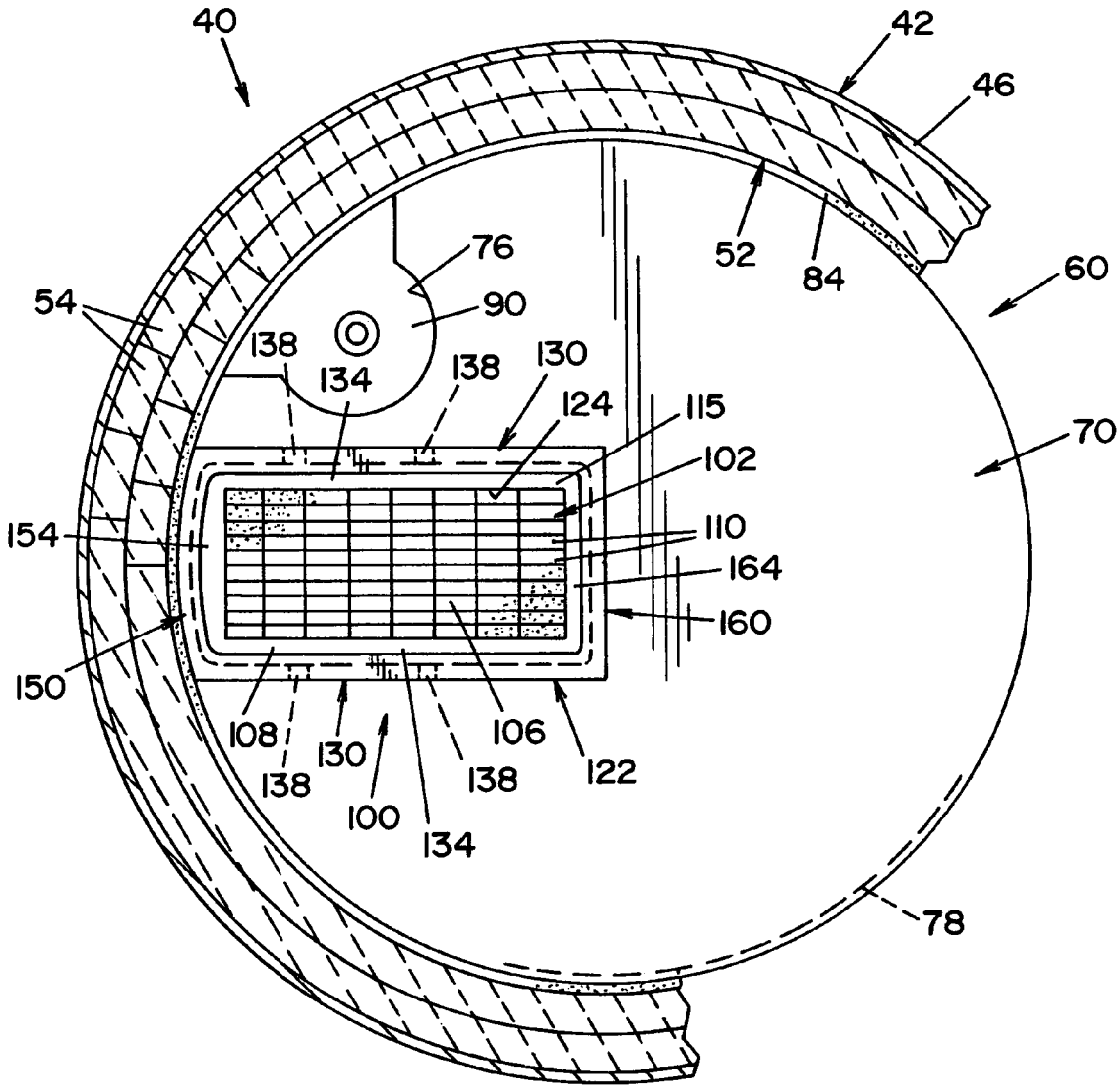
FIG. 2 is a top, sectional view of the ladle taken along lines 2-2 of FIG. 1.

Referring now to the drawings wherein the showings are for the purposes of illustrating a preferred embodiment of the invention only and not for the purposes of limiting same, FIGS. 1 and 2, show a ladle 40 for handling molten steel. Ladle has an outer metallic shell 42 comprised of a cup-shaped bottom 44 and a slightly conical side wall 46.

A refractory lining 52, comprised of two layers of refractory brick 54, is disposed along the inner surface of side wall 46. In the embodiment shown, refractory lining 52 of refractory bricks 54 extends along the entire side of shell 42 from bottom 44 to the open upper end of ladle 40, as best seen in FIG. 1.

A bottom lining 60 (best seen in FIG. 3) is adapted to be disposed on bottom 44 of ladle 40 within refractory lining 52. Bottom lining 60 is basically comprised of an impact pad 100, according to a first embodiment of the present invention, embedded within a monolithic, refractory slab 70 of refractory material 72. Bottom lining 60 may be "pre-formed" or "cast-in-place". With respect to a "pre-formed" bottom lining 60, impact pad 100 is pre-formed in a first mold and then placed into a second mold (not shown) to cast slab 70 in place around impact pad 100. After curing and setting, bottom lining 60 is removed from the second mold and placed within bottom 44 of ladle 40 as a pre-assembled unitary component. With respect to a "cast-in-place" bottom lining 60, impact pad 100 is preferably pre-formed outside of ladle 40 and then placed in bottom 44 of ladle 40. Thereafter, slab 70 is cast around impact pad 100 inside ladle 40. Bottom lining 60 is shown and described in the illustrated embodiment as a "pre-formed" bottom lining.

U.S. Pat. No. 6,673,306 entitled "Refractory Lining For Metallurgical Vessel" and U.S. Pat. No. 6,787,098 entitled "Refractory Lining For Metallurgical Vessel," which are expressly incorporated herein by reference, describe bottom linings for ladles that are both pre-formed and cast-in-place.

Refractory material 72 used to form slab 70 is selected based upon the desired operating characteristics and performance parameters of bottom lining 60. Various high-temperature refractory castables may find advantageous application in the present invention. In one embodiment of the present invention, a low-moisture, high alumina castable, manufactured and sold by North American Refractories Co. under the trade designations D-CAST 85 GOLD or HP-CAST ULTRA is used. Castables having 80% alumina content or higher are preferred.

Figure 3:
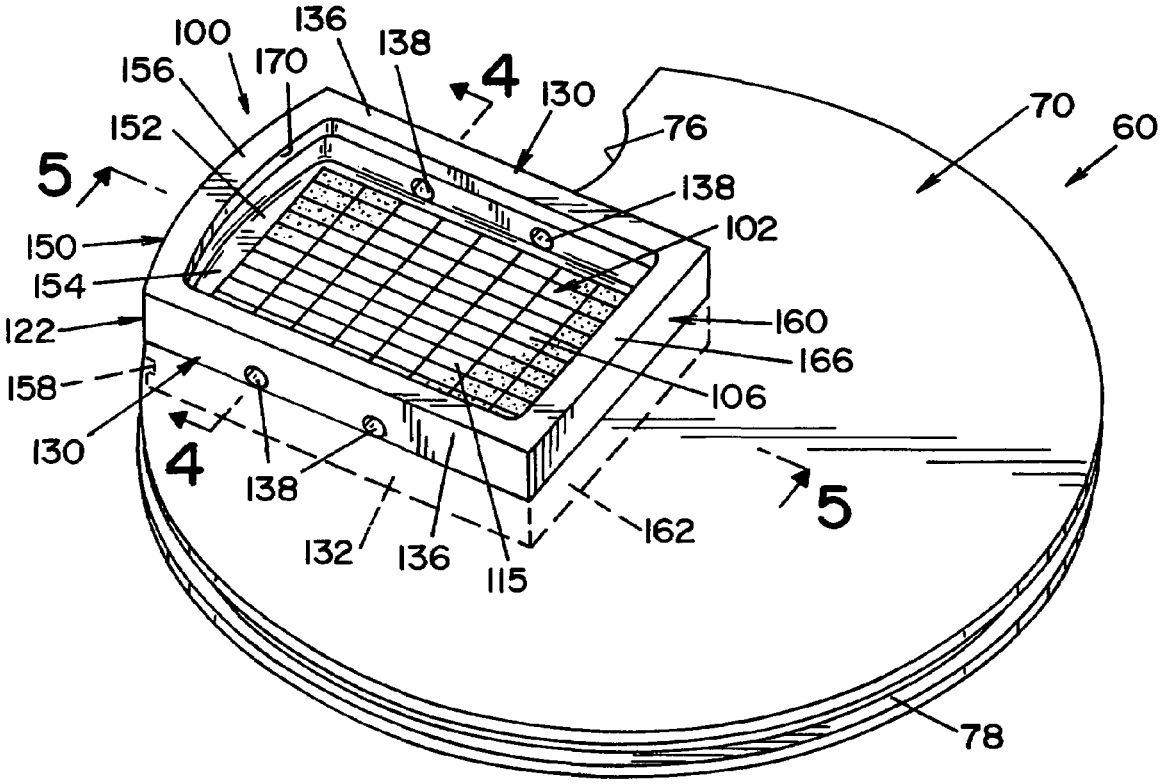
FIG. 3 is a perspective view of a bottom lining for a ladle as shown in FIGS. 1 and 2, showing the impact pad according to the first embodiment of the present invention.

Slab 70 is essentially circular in shape, and is dimensioned to match the circular opening in the bottom of ladle 40. It should be appreciated that ladle 40 may have an oval shape in which case bottom lining 60 would have an oval configuration to conform with the same. Slab 70 is formed to have a recess 76, best seen in FIG. 2, formed therein. Recess 76 is dimensioned to receive, in close mating fashion, a well block 90 (see FIG. 2). Well block 90 is secured within recess 76 of slab 70 by a casting or ramming refractory material. A U-shaped slot 78, best seen in FIG. 3, is formed in the peripheral edge of slab 70 to secure bottom lining 60 in ladle 40, as will be described below.

Multiple embodiments of an impact pad according to the present invention are disclosed herein. In the drawings of each embodiment, similar components bear the same reference numbers.

Figure 4:
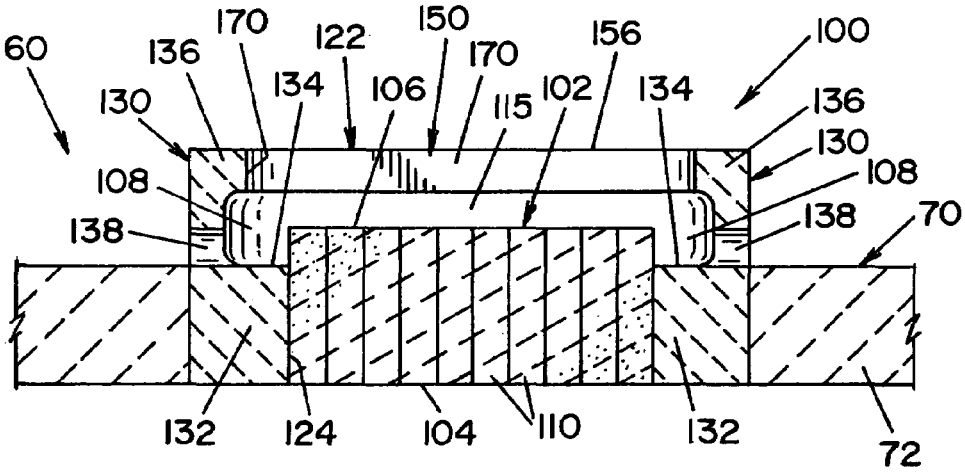
FIG. 4 is a sectional view taken along lines 4-4 of FIG. 3, showing a cross-section of the impact pad.
Figure 5:
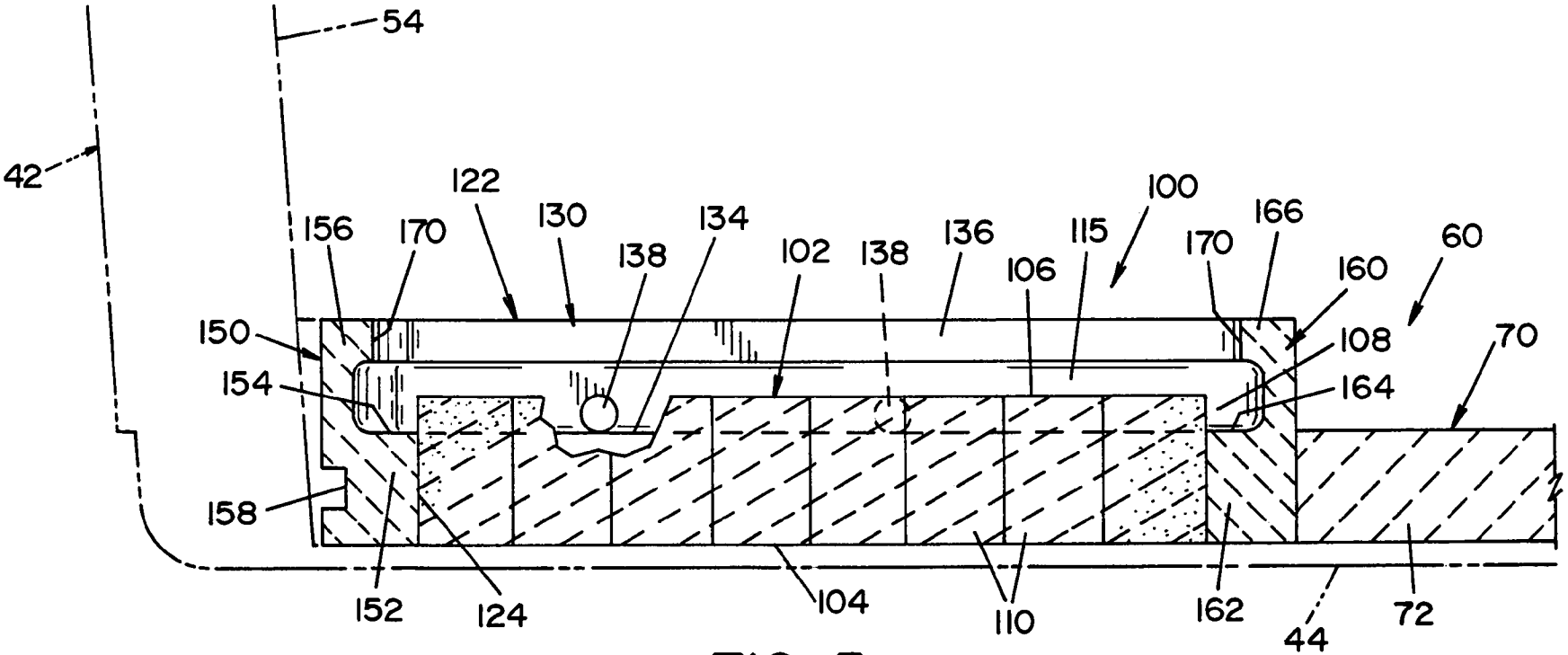
FIG. 5 is a sectional view taken along lines 5-5 of FIG. 3, showing a cross-section of the impact pad.

Impact pad 100, illustrating a first embodiment of the present invention, is positioned within ladle 40 to receive a stream of molten metal (not shown). As best seen in FIGS. 3-5, impact pad 100 is generally rectangular in shape and is comprised of a frame portion 122 and a bottom wall portion 102.

Frame portion 122 has a pair of side walls 130, a rear wall 150 and a front wall 160. Each side wall 130 has an inwardly extending lower section 132 and an upper section 136. One or more openings 138 extend through upper section 136 of side walls 130, as best seen in FIG. 3. Openings 138 allow molten metal received by the impact pad to flow onto slab 70 in a controlled manner. Rear wall 150 has an inwardly extending lower section 152 and an upper section 156, as best seen in FIG. 5. For a "pre-formed" bottom lining 60, as illustrated herein, a U-shaped slot 158 is formed in the outer surface of lower section 152 that matches U-shaped slot 78 formed in slab 70. Rear wall 150 is curved to match the profile of refractory lining 52 disposed along the inner surface of side wall 46. Front wall 160 has an inwardly extending lower section 162 and an upper section 166. In the illustrated embodiment, a wall 170 projects inwardly at the upper end of walls 130, 150 and 160 to form an inwardly projecting ledge. Inwardly extending lower sections 132, 152 and 162 of frame portion 122 define an opening 124 dimensioned to receive bottom wall portion 102, described in detail below.

Frame portion 122 of impact pad 100 is formed by conventional molding techniques, known to those skilled in the art. Frame portion 122 may be formed of many different types of refractory materials, but in a preferred embodiment, is formed of a high alumina refractory manufactured and sold by North American Refractories Co., Pittsburgh, Pa., under the trade designations D-CAST 85 GOLD, HP-CAST ULTRA or HP-CAST 94MA-C.

As best seen in FIGS. 4 and 5, bottom wall portion 102 has a lower surface 104 and an upper surface 106 adapted to receive a stream of molten metal (not shown). Preferably, upper surface 106 is a flat, generally planar, impact surface. In the illustrated embodiment upper surface 106 is located above respective upper surfaces 134, 154, and 164 of lower sections 132, 152 and 162 of frame portion 122. Accordingly, a channel 108 is formed around the periphery of bottom wall portion 102.

In the embodiment shown, bottom wall portion 102 is comprised of a plurality of tightly packed high-density and high-temperature refractory bricks 110 arranged in an upright, soldiered configuration. As used herein, the term "high density" refers to a refractory brick having an initial density of at least 180 lb/ft$^3$. The term "high temperature" refers to a brick capable of withstanding at least 2,900° F., the approximate melting temperature of steel.

Walls 130, 150, 160 and bottom wall portion 102 collectively define an interior cavity 115 of impact pad 100. Walls 130, 150 and 160 extend above refractory slab 70 and upper surface 106 of bottom wall portion 102. Molten metal is captured inside interior cavity 115. The inward projecting ledge formed by wall 170 helps maintain molten metal within interior cavity 115 .

As discussed above, and illustrated herein, bottom lining 60 may be formed as a pre-assembled, unitary bottom lining. Accordingly, frame portion 122 of impact pad 100 is cast around refractory bricks 110 in a first mold, and then impact pad 100 is placed into a second mold (not shown) to cast slab 70 in place around frame portion 122 of impact pad 100. As shown in FIGS. 1-3, bottom lining 60 is dimensioned to form a slight gap 82 between lining 52 of ladle 40 and the peripheral edge of bottom lining 60, as best seen in FIG. 1. Following insertion of pre-formed bottom lining 60 into bottom 44 of ladle 40, gap 82 is filled with a conventionally known, refractory castable or ramming material 84 to complete the refractory lining covering bottom 44 of ladle 40.

In an alternative method of assembly, bottom lining 60 is cast-in-place. Accordingly, frame portion 122 is cast around refractory bricks 110 in a mold, and then placed within ladle 40, where slab 70 is cast in place around frame portion 122. It should be understood that U-shaped slots 78 and 158, and gap 82 will not be present when bottom lining 60 is cast-in-place, since refractory material will fill any existing gaps during casting. It should be appreciated that bricks 110 of bottom wall portion 102 may be located within frame portion 122 at any suitable time during assembly of bottom lining 60.

Anchors or clips (not shown) may be embedded in frame portion 122 and slab 70 to reinforce the secure engagement of impact pad 100 with slab 70.

In the embodiment of the present invention shown in FIGS. 1-5, molten metal poured into ladle 40 will initially pool in interior cavity 115 of impact pad 100. The molten metal pooled inside cavity 115 will act to dampen splashing of molten metal subsequently poured into ladle 40. In this regard, as molten metal is poured into ladle 40 it will strike molten metal that has already pooled inside cavity 115, rather that directly striking bottom wall portion 102. Molten metal inside cavity 115 will exit cavity 115 in a controlled manner through openings 138 and by overrunning walls 130, 150, and 160. The initial containment of molten metal within cavity 115 and the controlled flow of molten metal via openings 138 will minimize turbulence. Moreover, rear wall 150 also provides protection to refractory lining 52 proximate to impact pad 100.

Further embodiments of an impact pad according to the present invention will now be described with reference to FIGS. 6-12. Elements of the further embodiments that are substantially the same as elements of the first embodiment shown in FIGS. 1-5 have been given the same reference numbers.

Figure 6:
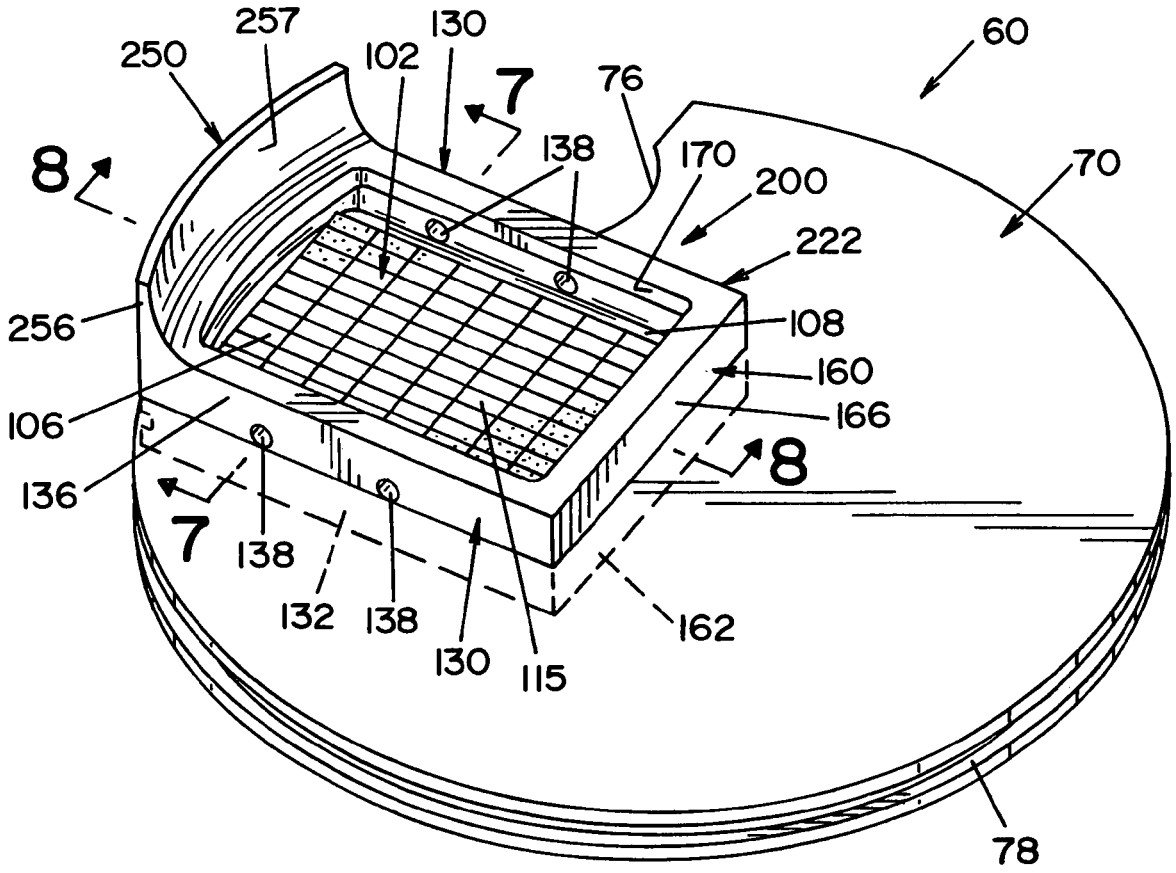
FIG. 6 is a perspective view of a bottom lining for a ladle, showing an impact pad according to a second embodiment of the present invention.
Figure 7:
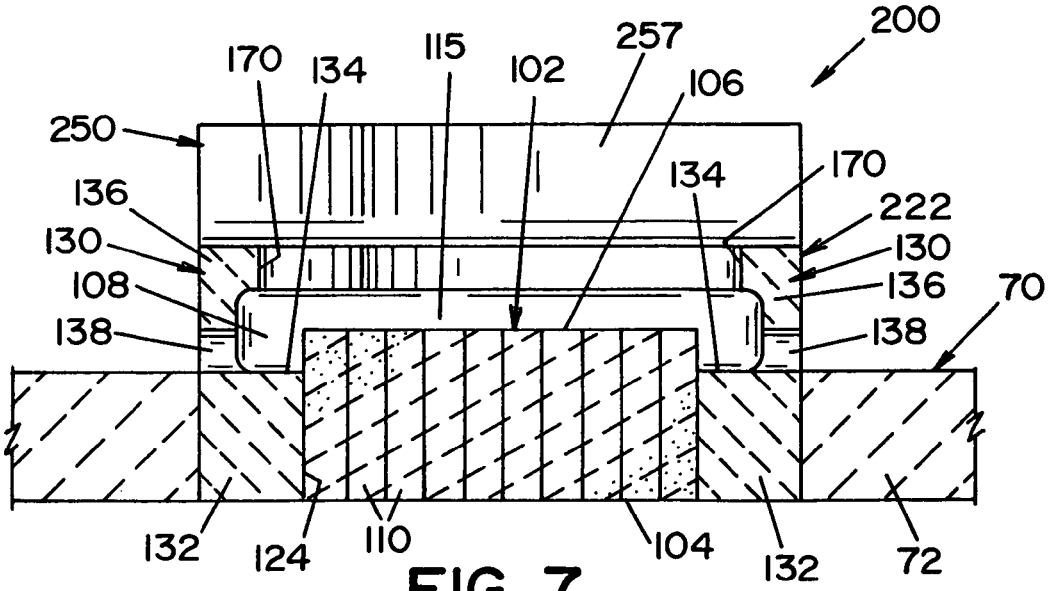
FIG. 7 is a sectional view taken along lines 7-7 of FIG. 6, showing a cross-section of the impact pad.
Figure 8:
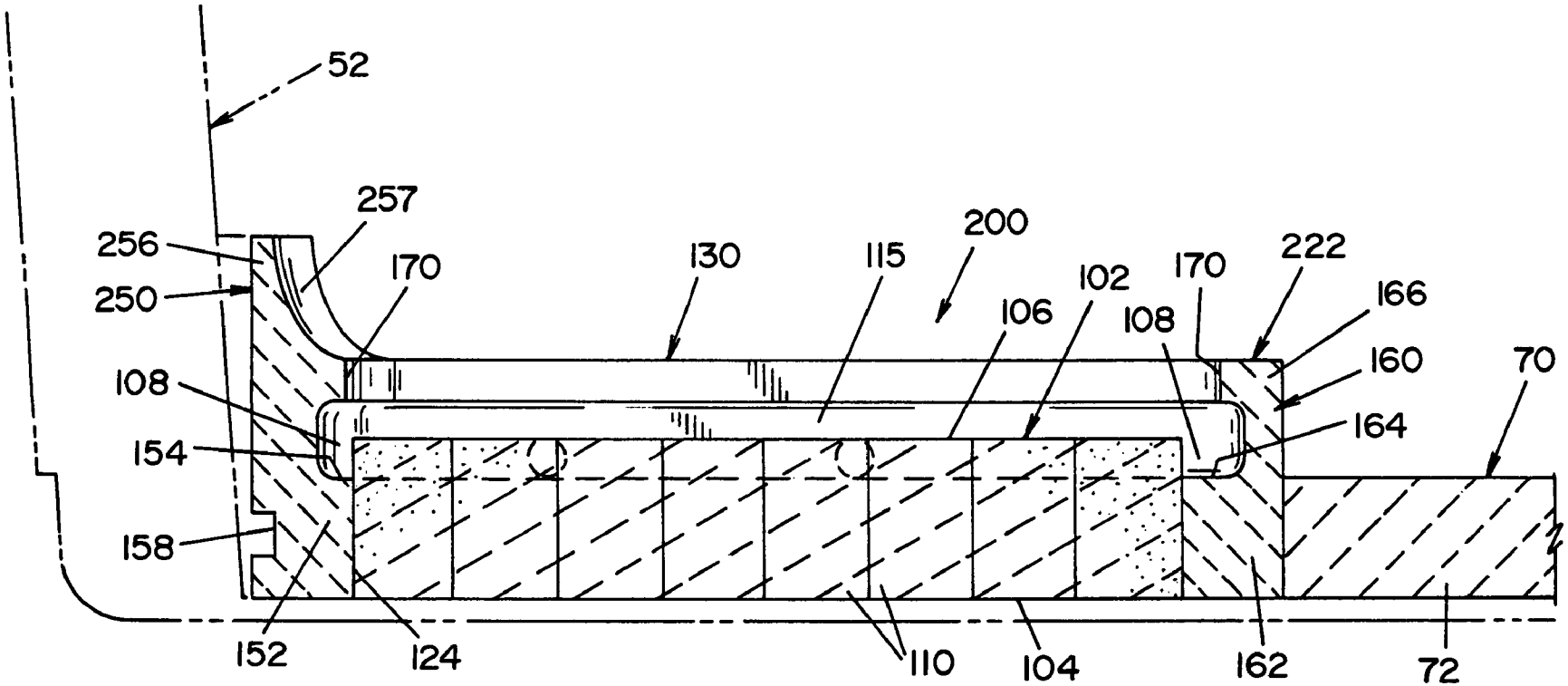
FIG. 8 is a sectional view taken along lines 8-8 of FIG. 6, showing a cross-section of the impact pad.

Referring now to FIGS. 6-8, a second embodiment of the present invention is shown. Impact pad 200 is similar in most respects to impact pad 100. However, frame portion 222 of impact pad 200 includes a rear wall 250 having an upper section 256 that extends further upward than upper section 156 of rear wall 150 of impact pad 100. Accordingly, rear wall 250 has a height that is greater than the height of side walls 130 and front wall 160. Like rear wall 150 of impact pad 100, rear wall 250 is curved to match the profile of refractory lining 52 disposed along the inner surface of side wall 46. The increased height of rear wall 250 provides additional protection to refractory lining 52 from splashing of molten metal. As best seen in FIG. 8, upper section 256 has a sloped front face 257 for directing molten metal toward interior cavity 115.

In the embodiment of the present invention shown in FIGS. 6-8, the increased height of rear wall 250, as compared to rear wall 150, provides additional protection to refractory lining 52 proximate to impact pad 200.

Figure 9:
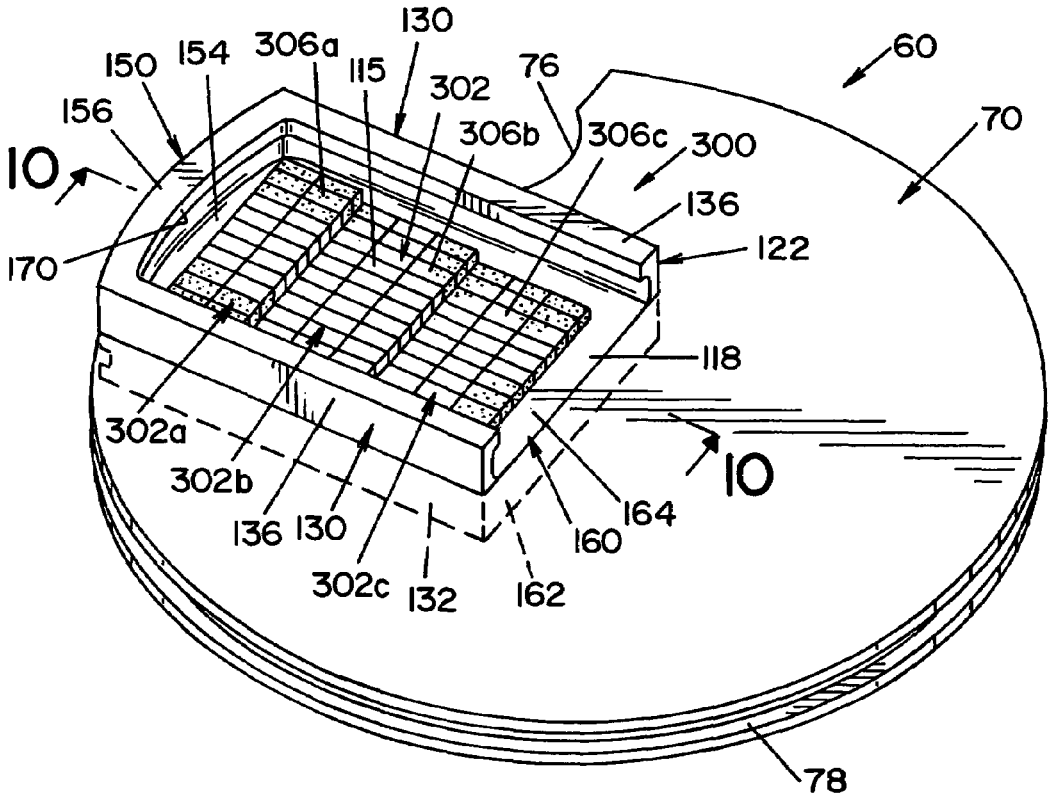
FIG. 9 is a perspective view of a bottom lining for a ladle, showing an impact pad according to a third embodiment of the present invention.
Figure 10:
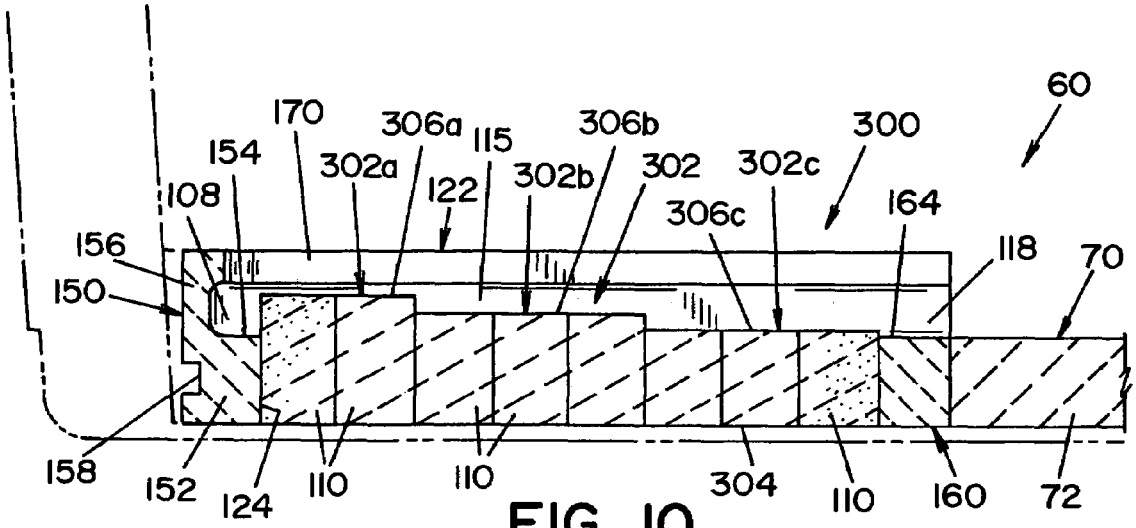
FIG. 10 is a sectional view taken along lines 10-10 of FIG. 9, showing cross-section of the impact pad.

FIGS. 9-10 illustrate a third embodiment of the present invention. Impact pad 300 has a bottom wall portion 302 comprised of differently sized refractory bricks 110 arranged in an upright, soldiered configuration. In this regard, different sizes of bricks 110 are arranged to form bottom wall portion 302 having multiple sections, designated 302*a*, 302*b*, and 302*c* that form a stepped configuration. Bottom wall portion 302 has an upper surface comprised of surfaces 306*a*, 306*b* and 306*c* that correspond respectively to sections 302*a*, 302*b* and 302*c*. Bottom wall portion 302 has a generally planar lower surface 304. Upper section 166 is omitted from front wall 160, thus providing an opening 118 for the flow of molten metal out of interior cavity 115, as it descends the stepped configuration of bottom wall portion 302.

In the embodiment of the present invention shown in FIGS. 9-10, the stepped configuration of bottom wall portion 302 guides molten metal toward the center of ladle 40. In this regard, molten metal flows out of impact pad 300 through the opening 118 in front wall 160 formed by the absence of upper section 166.

Figure 11:
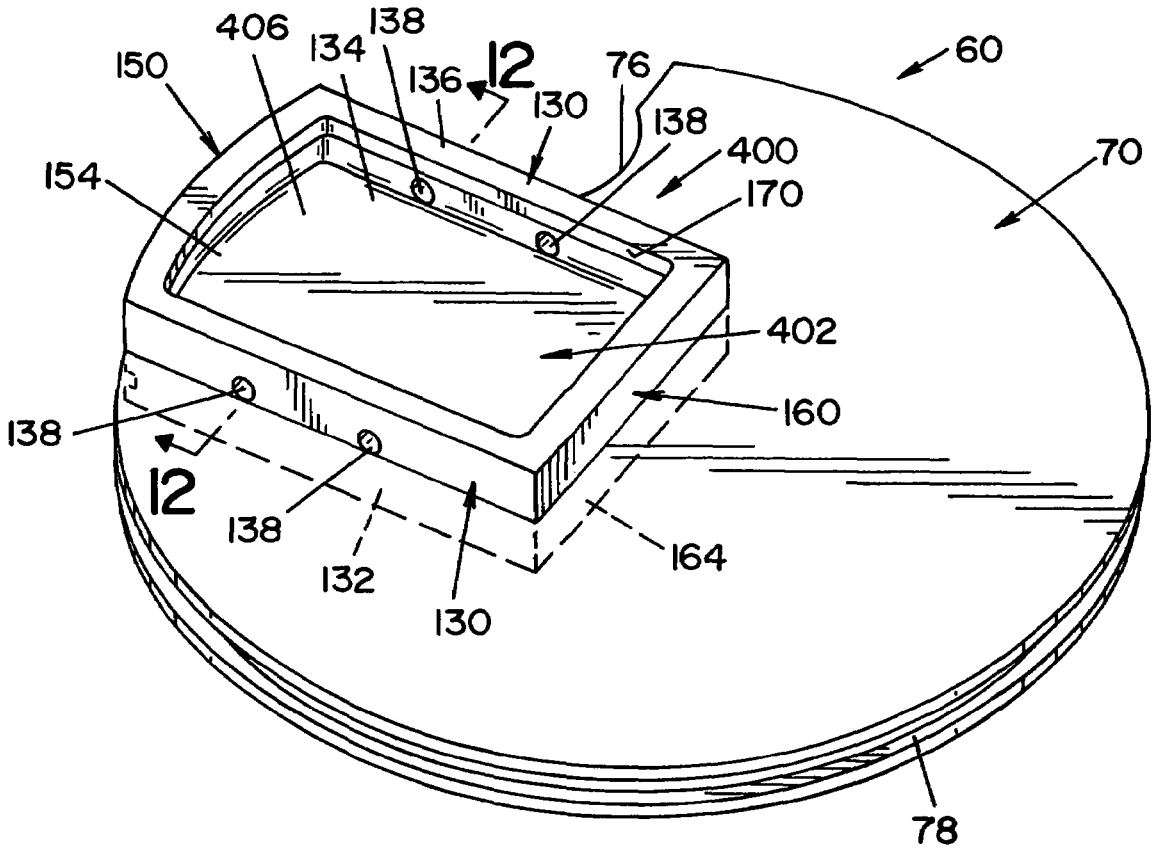
FIG. 11 is a perspective view of a bottom lining for a ladle, showing an impact pad according to a fourth embodiment of the present invention.
Figure 12:
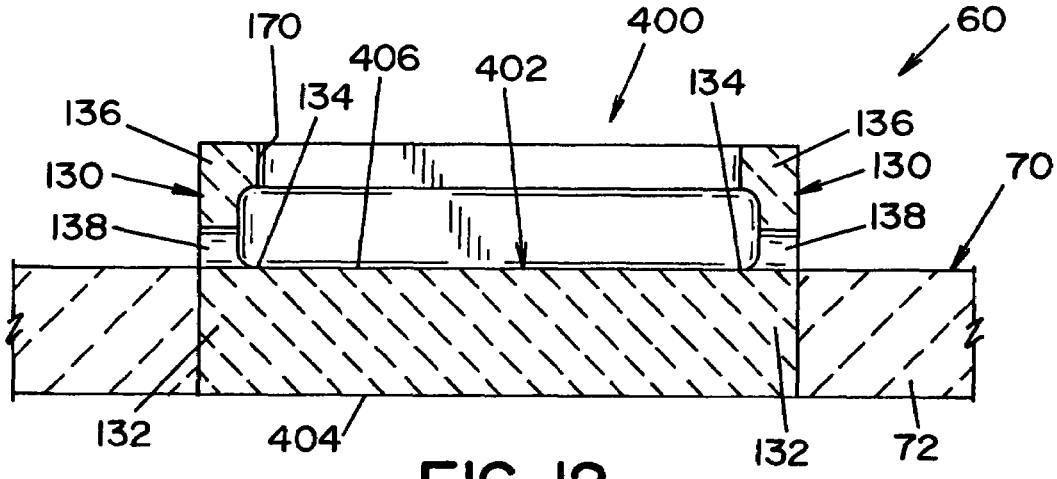
FIG. 12 is a sectional view taken along lines 12-12 of FIG. 11, showing cross-section of the impact pad.

Referring now to FIGS. 11 and 12, there is shown a fourth embodiment of the present invention. Impact pad 400 is similar in most regards to impact pad 100. However, impact pad 400 has a bottom wall portion 402 that is made of a cast refractory material. In this respect, bottom wall portion 402 is integrally cast with lower sections 132, 152 and 162 of side walls 130, rear wall 150 and front wall 160 to form a unitary impact pad. In the illustrated embodiment, bottom wall portion 402 has a generally planar lower surface 404 and a generally planar upper surface 406. Upper surface 406 matches the profile of the respective upper surfaces 134, 154, and 164 of lower sections 132, 152, and 162 of side walls 130, rear wall 150, and front wall 160. In the embodiment of the present invention shown in FIGS. 11-12, the molten metal will generally flow in the same manner as in the embodiment shown in FIGS. 1-5. In an alternative embodiment, impact pad 400 may be modified to more closely resemble impact pad 300. In this regard, front wall 160 is removed and bottom wall portion 402 is cast to have a sloped or stepped upper surface 406.

It should be understood that an impact pad, according to the present invention, may assume other shapes and configurations, and may be disposed in other regions of bottom lining 60, without deviating from the present invention. Furthermore, in an alternative embodiment of the present invention all or at least a portion of the refractory cast material of slab 70 may be substituted with refractory bricks. It should be further appreciated that each embodiment of the impact pad described above may be modified to incorporate one or more features of the other embodiments.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. An impact pad for receiving a stream of molten metal in a ladle, said impact pad comprising:

a bottom wall portion with an upper surface against which the molten metal is intended to impact, said bottom wall portion comprised of a plurality of refractory bricks; and a frame portion surrounding the bottom wall portion and comprised of a cast refractory material, said frame portion having:

first and second side walls extending in an upward direction along the periphery of the bottom wall portion, and a rear wall extending in an upward direction along the periphery of the bottom wall portion, wherein said frame portion is cast around said bottom wall portion to form a pre-assembled component.

2. An impact pad according to claim 1, wherein said frame portion further comprises:

a front wall extending in an upward direction along the periphery of the bottom wall portion.

3. An impact pad according to claim 2, wherein each of said first and second side walls, said rear wall and said front wall include an inward projecting ledge.

4. An impact pad according to claim 1, wherein each of said first and second side walls and said rear wall include an inward projecting ledge.

5. An impact pad according to claim 1, wherein said plurality of refractory bricks are arranged in a stepped configuration.

6. An impact pad according to claim 1, wherein said plurality of refractory bricks are arranged in an upright soldiered configuration.

7. An impact pad according to claim 2, wherein at least one opening extends through at least one of said walls.

8. An impact pad according to claim 1, wherein said rear wall includes an extension portion extending above said first and second side walls.

9. An impact pad according to claim 8, wherein said extension portion includes a sloped front face.

10. An impact pad according to claim 1, wherein said rear wall is curved to match the profile of a wall of the ladle.

11. An impact pad according to claim 1, wherein said first and second side walls, rear wall and bottom wall portion define a molten metal receiving cavity.

12. An impact pad according to claim 1, wherein said upper surface of the bottom wall portion is generally planar.

13. An impact pad according to claim 1, wherein said upper surface of the bottom wall portion is stepped.

14. An impact pad according to claim 1, wherein said impact pad is adapted to be encased in a monolithic slab of a high-temperature refractory material.

15. A lining for a bottom of a ladle, comprising:

an impact pad comprised of:

a bottom wall portion with an upper surface against which the molten metal is intended to impact, said bottom wall portion comprised of a plurality of refractory bricks; and a frame portion surrounding the bottom wall portion and comprised of a cast refractory material, said frame portion having:

first and second side walls extending in an upward direction along the periphery of the bottom wall portion, and a rear wall extending in an upward direction along the periphery of the bottom wall portion; and a high-temperature refractory material encasing a substantial lower portion of said impact pad.

16. A lining according to claim 15, wherein said high-temperature refractory material is a monolithic slab cast around said impact pad in a mold to pre-assemble said lining.

17. A lining according to claim 15, wherein said high-temperature refractory material is a monolithic slab cast around said impact pad inside said ladle.

18. A lining according to claim 15, wherein said first and second side walls and said rear wall extend above an upper surface of said high-temperature refractory material encasing said impact pad.

19. A lining according to claim 15, wherein said frame portion further comprises:

a front wall extending in an upward direction along the periphery of the bottom wall portion.

20. A lining according to claim 19, wherein each of said first and second side walls, said rear wall and said front wall include an inward projecting ledge.

21. A lining according to claim 15, wherein each of said first and second side walls and said rear wall include an inward projecting ledge.

22. A lining according to claim 15, wherein said plurality of refractory bricks are arranged in a stepped configuration.

23. A lining according to claim 15, wherein said plurality of refractory bricks are arranged in an upright soldiered configuration.

24. A lining according to claim 19, wherein at least one opening extends through at least one of said walls.

25. A lining according to claim 15, wherein said rear wall includes an extension portion extending above said first and second side walls.

26. A lining according to claim 25, wherein said extension portion includes a sloped front face.

27. A lining according to claim 15, wherein said rear wall is curved to match the profile of a wall of the ladle.

28. A lining according to claim 15, wherein said first and second side walls, rear wall and bottom wall portion define a molten metal receiving cavity.

29. A lining according to claim 15, wherein said upper surface of the bottom wall portion is generally planar.

30. A lining according to claim 15, wherein said upper surface of the bottom wall portion is stepped.

31. A lining for a bottom of a ladle, comprising:

an impact pad comprised of:

a bottom wall portion formed of a refractory material, said bottom wall portion having an upper surface against which molten metal is intended to impact; and a frame portion surrounding the bottom wall portion and comprised of a cast refractory material, said frame portion integrally cast with said bottom wall portion, said frame portion having:

first and second side walls extending in an upward direction along the periphery of the bottom wall portion, and a rear wall extending in an upward direction along the periphery of the bottom wall portion; and a high-temperature refractory material encasing a substantial lower portion of said impact pad, wherein said first and second side walls and said rear wall of the impact pad extend above an upper surface of said high-temperature refractory material encasing the substantial lower portion of said impact pad.

32. A lining according to claim 31, wherein said high-temperature refractory material is a monolithic slab cast around said impact pad in a mold to pie-assemble said lining.

33. A lining according to claim 31, wherein said high-temperature refractory material is a monolithic slab cast around said impact pad inside said ladle.

34. A lining according to claim 31, wherein said frame portion further comprises:

a front wall extending in an upward direction along the periphery of the bottom wall portion.

35. A lining according to claim 34, wherein each of said first and second side walls, said rear wall and said front wall include an inward projecting ledge.

36. A lining according to claim 31, wherein each of said first and second side walls and said rear wall include an inward projecting ledge.

37. A lining according to claim 34, wherein said front wall extends above the upper surface of said high-temperature refractory material.

38. A lining according to claim 34, wherein at least one opening extends through at least one of said walls.

39. A lining according to claim 31, wherein said rear wall includes an extension portion extending above said first and second side walls.

40. A lining according to claim 39, wherein said extension portion includes a sloped front face.

41. A lining according to claim 31, wherein said rear wall is curved to match the profile of a wall of the ladle.

42. A lining according to claim 31, wherein said first and second side walls, rear wall and bottom wall portion define a molten metal receiving cavity.

43. A lining according to claim 31, wherein the upper surface of said bottom wall portion is generally planar.

44. A lining according to claim 31, wherein the upper surface of said bottom wall portion is non-planar.

45. A lining according to claim 31, wherein said bottom wall portion is comprised of a plurality of refractory bricks.

46. An impact pad for receiving a stream of molten metal in a ladle, said impact pad comprising:

a bottom wall portion with an upper surface against which the molten metal is intended to impact, said bottom wall portion comprised of a first refractory material; and a frame portion surrounding the bottom wall portion and comprised of a second refractory material, said frame portion including:

first and second side walls extending in an upward direction along the periphery of the bottom wall portion, and a rear wall extending in an upward direction along the periphery of the bottom wall portion, wherein said frame portion is cast around said bottom wall portion to form a pre-assembled component.

47. An impact pad according to claim 46, wherein said first refractory material is the same as said second refractory material.

48. An impact pad according to claim 46, wherein said first and second refractory materials are cast refractory materials.

49. An impact pad according to claim 46, wherein said frame portion further comprises:

a front wall extending in an upward direction along the periphery of the bottom wall portion.

50. An impact pad according to claim 49, wherein at least one opening extends through at least one of said first and second side walls.

51. An impact pad according to claim 46, wherein said rear wall is curved to match the profile of a wall of the ladle.

52. An impact pad according to claim 46, wherein said impact pad is adapted to be encased in a monolithic slab of a high-temperature refractory material.

53. An impact pad for receiving a stream of molten metal in a ladle, said impact pad comprising:

a bottom wall portion having an upper surface against which the molten metal is intended to impact;

first and second side walls extending in an upward direction along the periphery of the bottom wall portion; and a rear wall extending in an upward direction along the periphery of the bottom wall portion;

wherein a surface of at least one of the first side wall, the second side wall and the rear wall includes engagement means for securing engagement of the impact pad with a refractory material encasing the impact pad within the ladle, and wherein the bottom wall portion, the first and second side walls and the rear wall are comprised of a refractory material and form an integral cast component.

54. An impact pad according to claim 53, wherein said engagement means is a member extending from at least one of said first side wall, said second side wall and said rear wall.

55. An impact pad according to claim 53, wherein said engagement means is an anchor embedded in at least one of the first side wall, the second side wall and the rear wall.

56. An impact pad according to claim 53, wherein said impact pad further comprises:

a front wall extending in an upward direction along the periphery of the bottom wall portion.

57. An impact pad according to claim 56, wherein at least one opening extends through at least one of said walls.

58. An impact pad according to claim 53, wherein said rear wall is curved to match the profile of a wall of the ladle.

59. An impact pad according to claim 53, wherein said refractory material encasing the impact pad is a monolithic slab cast around said impact pad.

60. An impact pad for receiving a stream of molten metal in a ladle, said impact pad comprising:

a bottom wall portion with an upper surface against which the molten metal is intended to impact said bottom wall portion comprised of a plurality of refractory bricks; and a frame portion surrounding the bottom wall portion and comprised of a cast refractory material, said frame portion extending in an upward direction along the periphery of the bottom wall portion to surround at least a major portion of the bottom wall portion, wherein said frame portion is cast around said bottom wall portion to form a pre-assembled component.

61. An impact pad according to claim 60, wherein said frame portion includes a curved wall section.

62. An impact pad according to claim 60, wherein said frame portion includes first and second side walls and a rear wall extending therebetween.

63. An impact pad according to claim 62, wherein said frame portion further comprises:

a front wall extending in an upward direction along the periphery of the bottom wall portion.

64. An impact pad according to claim 60, wherein said frame portion includes an inward projecting ledge.

65. An impact pad according to claim 60, wherein at least one opening extends through said frame portion.

66. An impact pad according to claim 60, wherein said frame portion and said bottom wall portion collectively define a molten metal receiving cavity.

67. An impact pad according to claim 60, wherein said upper surface of the bottom wall portion is generally planar.

68. An impact pad according to claim 60, wherein said impact pad is adapted to be encased in a refractory material.

* * * * *